United States Patent [19]

Ganz et al.

[11] Patent Number: 4,925,019

[45] Date of Patent: May 15, 1990

[54] ARTICLE CARRIER WITH END PANELS

[75] Inventors: Robert H. Ganz, Saddle River, N.J.; Robert L. Sutherland, Campbell Hall, N.Y.

[73] Assignee: Federal Paper Board, Montvale, N.J.

[21] Appl. No.: 271,854

[22] Filed: Nov. 16, 1988

[51] Int. Cl.[5] ..... B65D 65/12; B65D 65/28

[52] U.S. Cl. ..... 206/145; 206/611; 206/427; 229/40; 53/458; 53/443

[58] Field of Search ..... 206/427, 434, 605, 608, 206/611, 612, 139, 140, 145, 155, 161; 229/40, 52 BC; 53/49, 50, 458, 443, 452

[56] References Cited

U.S. PATENT DOCUMENTS

| | | | |
|---|---|---|---|
| 3,128,010 | 4/1964 | Forrer | 206/140 |
| 3,167,214 | 1/1965 | Mahon | 229/40 |
| 4,382,505 | 5/1983 | Sutherland et al. | 206/427 |
| 4,597,523 | 7/1986 | Schuster | 206/427 |
| 4,732,316 | 3/1988 | Oliff et al. | 206/427 |

*Primary Examiner*—Paul T. Sewell
*Assistant Examiner*—Jacob K. Ackun, Jr.
*Attorney, Agent, or Firm*—Charles E. Brown; Charles A. Brown

[57] ABSTRACT

This relates to a wraparound carrier for the packaging of articles in two rows. Primarily the articles are bottles. The wraparound carrier is provided at each end with a trap gusset and a pair of end panels. The gusset is specifically configurated to fold beneath an arched shaped top of a conventional wraparound container so as to effect the maintaining of the formed configuration of the upper part of the wraparound carrier while holding the associated end panels in a planar relationship. Not only does the relationship between the gusset and end panels at each end of the carrier provide for a complete closing of the carrier such as desired in the packaging of certain beers and other products, but also even after the carrier has been opened and the bottles or like articles removed therefrom, the gusset and the associated end panels cooperate with one another to maintain the shape of the erected carrier so that the opened carrier may have replaced therein the used bottles for return. The relationship of the gusset and the end panels to the remainder of the wraparound carrier permits the end panels and gusset to be folded within the confines of the carrier in advance of application of the carrier to a group of articles so that no space between article groups is required for folding of either the gusset or the end panels and therefore a maximum production can be obtained.

20 Claims, 3 Drawing Sheets

ARTICLE CARRIER WITH END PANELS

This invention relates in general to new and useful improvements in article carriers, and most particularly to an article carrier which is provided with end panels so that articles packages within the article carrier are substantially entirely confined within the article carrier.

Most particularly, this invention relates to an article carrier which is useful in packaging beer and other products which are affected by light, the article carrier being provided with end panels or doors which enclose the bottles or like articles and generally prevent the entrance of light into the interior of the article carrier.

Most particularly, this invention relates to an article carrier which is formed of paperboard or like product from a flat blank and wherein the article carrier is of the wraparound type including a central portion which wraps around a group of containers, for example, six bottles, and interlocks therewith. Such an article carrier is provided at opposite ends thereof with an upper gusset and end panels with the gusset being hingedly connected to the top of the article carrier and the end panels being hingedly connected to side panels of the article carrier.

Another feature of the invention is to provide an article carrier having at opposite ends thereof integral gusset and end panels and wherein the gusset and end panels, when folded relative to the remainder of the article carrier, function as form retention means so that even after articles have been removed from the article carrier, it maintains its erected shape.

Another feature of the invention is the provision of an article carrier which is provided with end panels connected to top portions of the carrier by a gusset trap arrangement and wherein the article carrier is of a configuration wherein it may be partially erected with the end panels in their transverse positions and the gusset trap arrangement folded beneath the carrier top portion prior to the assembling of the article carrier with plural articles so that there is substantially no space between adjacent article carriers and groups of articles which are being packages.

This invention in particularly relates to the modification of a conventional type of article carrier to include gussets and end panels which not only function to close the ends of the article carrier, but also serve to be of a form retaining type.

With the above and other objects in view that will hereinafter appear, the nature of the invention will be more clearly understood by reference to the following detailed description, the appended claims, and the several views illustrated in the accompanying drawings.

Figure 1:
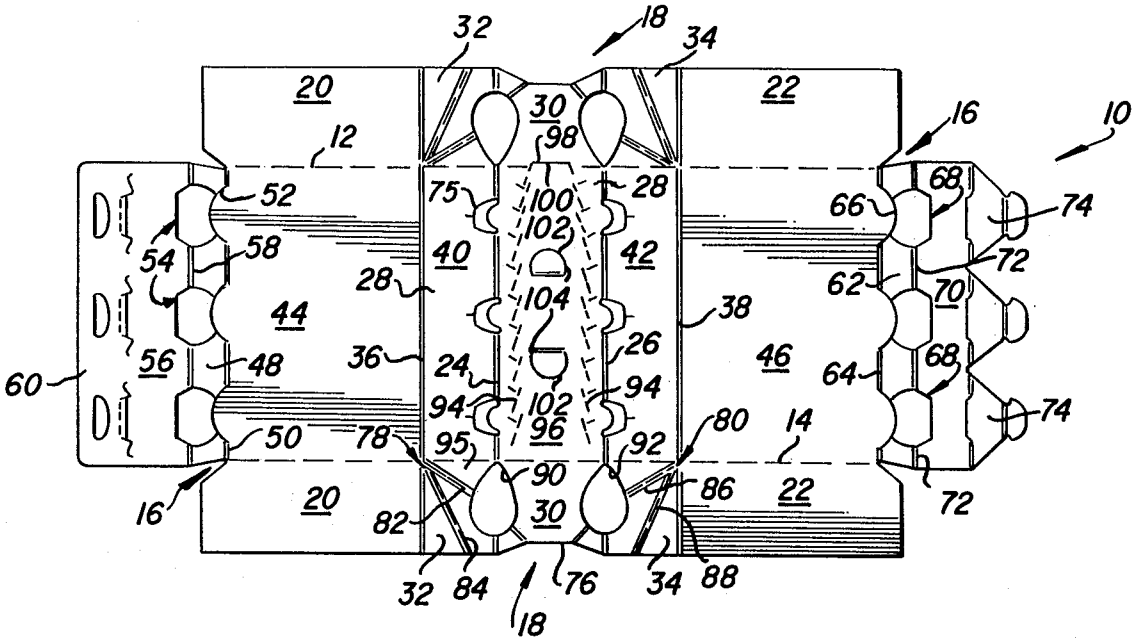
FIG. 1 is a bottom plan view of a blank from which the article carrier of this invention is formed.

Referring now to the drawings in detail, FIG. 1 is a bottom plan view of a blank for an article carrier formed in accordance with this invention, the blank being generally identified by the numeral 10. The blank 10 is in sheet form and is generally rectangular in outline. The blank 10 is preferably formed of paperboard, although it may be formed of other sheet material.

It will be seen that the blank 10 is provided with a pair of longitudinal fold lines 12, 14 between which there is defined an article carrier, generally identified by the numeral 16 and outside of which there is on each side of the article carrier 16, a centrally positioned gusset 18 and remotely disposed end panels 20, 22 which are connected to the artiel carrier 16 along the fold lines 12, 14.

The article carrier 16 is generally of a conventional construction except for an opening detail thereof. The article carrier 16 is defined by a plurality of transverse fold lines including first transverse fold lines 24, 26 which set off a central top panel 28. The fold lines 24, 26 extend across the gussets 18 and divide each gusset 18 into a gusset central panel 30 and gusset outer panels 32, 34.

Second transverse fold lines 36, 38 set off outer top panels 40, 42 which are hingedly connected to the central top panel 28 along the fold lines 24, 26, respectively. The fold lines 36, 38 also hingedly connect the end panels 20, 22, respectively, to the gusset 18.

The article carrier 16 also includes side panels 44, 46 which are hingedly connected to the outer top panels 40, 42, respectively and to which the end panels 20, 22, respectively, are connected by the fold lines 12, 14.

A sloping bottom panel 48 is hingedly connected to the side panel 44 along an interrupted fold line 50 with portions of the panel 48 being interrupted by a combination of generally C-shaped cuts 52 and cutouts 54. A partial bottom panel 56 is connected to the sloping bottom panel 48 by an interrupted fold line 58 which is interrupted by the cutouts 54.

The bottom panel 56 carries a locking flap 60 which is disposed along one free edge of the blank 10.

A sloping bottom panel 62 is also carried by the side panel 46 along an interrupted fold line 64. The fold line 64 is interrupted by generally arcuate cuts 66 in conjunction with openings 68. A second partial bottom panel 70 is connected to the sloping bottom panel 62 along a fold line 72 which is also interrupted by the cutouts 68.

The partial bottom panel 70 carries a plurality of projecting locking tabs which are generally defined by the numeral 74.

it is also to be noted that the fold lines 24, 26 are also interrupted by cutouts 75 which are aligned with the cutouts 54, 68.

The article carrier 16 is specifically configurated for the packaging of six containers generally in the form of bottles having crowns. The bottle crowns abut against the underside of the central top panel 28 and project into the openings 75 with the outer panels 40, 42 sloping downwardly.

When the article carrier 16 is wrapped around a group of six articles, such as containers in the form of bottles, as the partial bottom panels 56, 70 are drawn beneath the containers, a base portion of each container will partially project through one of the openings 54, 68 to form a further interlock between the articles and the article carrier. The partial bottom panels 56, 70 are locked together by the illustrated and only partially described conventional interlocking means. The interlocking means are known in the art and not part of this invention.

The gusset central panels 30 are provided at the outer ends thereof with cutouts 76. Each gusset 18 has two corners, one corner being defined by the fold lines 14 and 36 and identified by the numeral 78, and the other corner is defined by the intersection of the fold lines 14 and 38 and identified by the numeral 80.

A first diagonal fold line 82 extends from the corner 78 across the gusset outer panel 32 and the gusset central panel 30 and terminates at a base of the cutout 76. A second diagonal fold line 84 extends from the corner 78 across the gusset outer panel 32. It will be seen that the fold lines 82, 84 are generally at a 30° angle to each other with the fold line 82 being at a 30° angle to the fold line 14 and the fold line 84 being at a 30° angle to the fold line 36.

A first diagonal fold line 86 and a second diagonal fold line 88 extend from the corner 80 in the same manner as the fold lines 82, 84.

Figure 3:
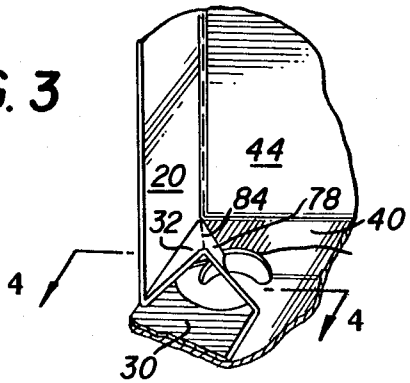
FIG. 3 is a fragmentary perspective view of the blank with the gusset and one end panel completely folded and the article carrier being partially folded.

The gusset 18 is provided with two relief openings 90, 92 which are mirror images of one another and which bridge the fold lines 24, 82 and the fold lines 26, 86, respectively. In use, as a blank 10 is being applied to a group of articles, such as six bottles B, the gussets 18 are reversely folded along the fold lines 12, 14 into underlying relation with respect to the central top panel 28 as is shown in FIG. 3. It is to be understood, however, that the illustration of FIG. 3 is inverted so that the gussets 18 are being folded underneath the central top panel 28 and not over as is shown in FIG. 3.

It is to be noted that the relief openings 90, 92 are generally tear drop in outline and are pointed with the opening extending to the fold lines 12, 14 so that the gussets 18 may generally fold on the openings.

Further, it is to be understood that immediately prior to the initial folding or during the initial folding of the gussets 18, a suitable adhesive A may be selectively applied to either the gusset 18 or the underside of the central top panel 28. Then when the gusset 18 is reversely folded against the underside of the central top panel 28, it will become bonded thereto.

During a further folding of the blank 10, with folding being effected along the transverse fold lines 24, 26, 36 and 38, folding of the gussets 18 along the diagonal fold lines 82, 84, 86, 88 will be effected and while the top panels 28, 40 and 42 together with the side panels 44, 46 will assume a generally inverted U-shaped configuration, the gusset outer panels 32, 34 will be folded upon themselves and the end panels 20, 22 will assume a generally common planar relationship. An inverted view of a portion of the blank 10 so folded is shown in FIG. 3. At this time it is to be noted that a portion 95 of the gusset outer panel 32 lying between the fold lines 14, 82 will come into flush engagement with the underside of the outer top panel 40 while a like portion 96 of the gusset outer panel 34 with come into flush contact with the underside of the outer top panel 42. This is clearly shown in FIG. 3. Further, it will be seen that with each gusset outer panel 32, 34 being generally reversely folded upon its respective first diagonal fold line 82, 86, each of the openings 90, 92 will be divided into two parts overlying each other. Further, the folded openings 90, 92 will be aligned with respective end ones of the openings 74 so as to clear the upper portion of an article, such as the neck finish and crown of a bottle.

Figure 4:
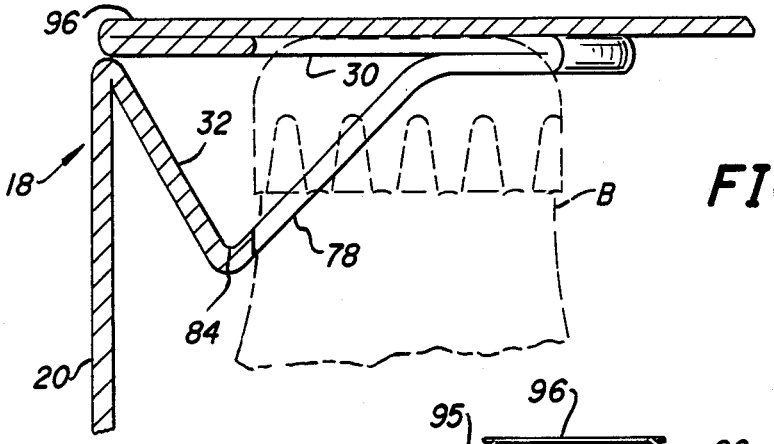
FIG. 4 is an enlarged fragmentary vertical sectional view taken along the line 4—4 of FIG. 3 with the article carrier being inverted and applied to a container.

The relationship of the folded gusset 18 and the associated central top panel and outer panel to a bottle which has been incorporated in the article carrier is best shown in FIG. 4.

Figure 2:
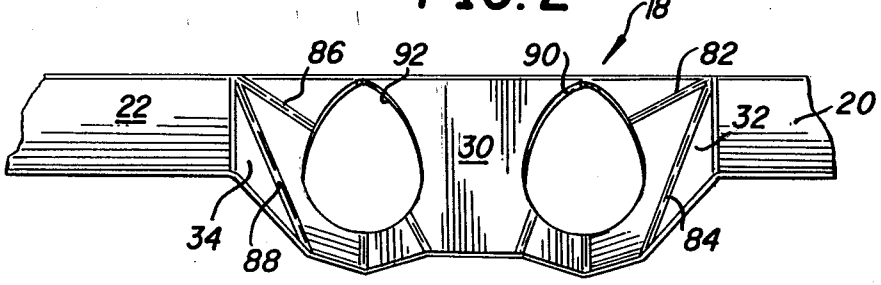
FIG. 2 is an end elevational view of the blank with one gusset arrangement and the associated end panels folded down at one end of the blank in the first step of forming the article carrier from the blank.
Figure 5:
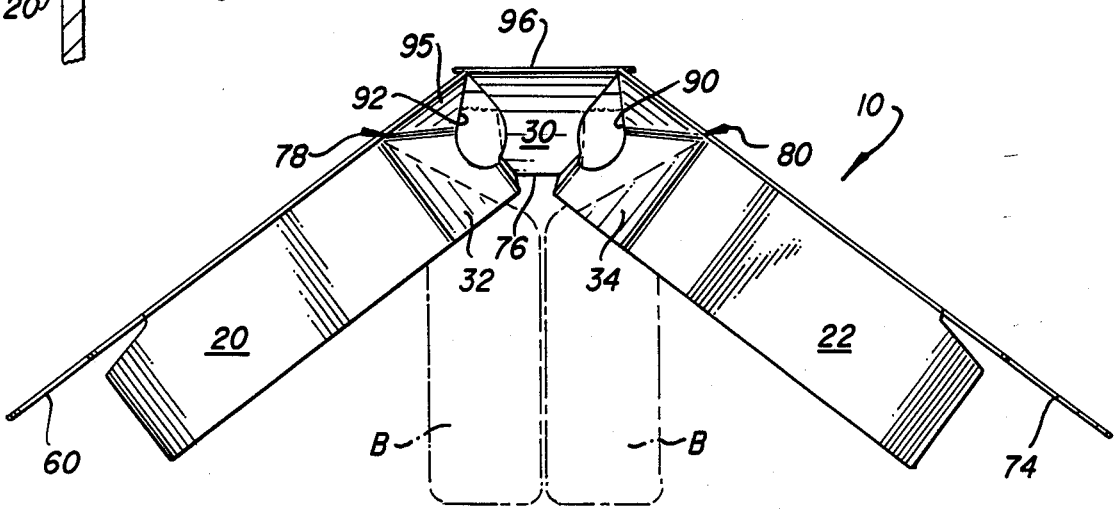
FIG. 5 is a schematic elevational view showing the partially folded article carrier positioned on moving rows of containers in position depending on and interlocking with a group of containers.

Reference is now made to the schematic view of FIG. 5 wherein the partially folded blank 10 of FIG. 2 is illustrated as being positioned on and partially folded down on a group of six bottles arranged in two rows. It is to be understood that because the end panels 20, 22 at each side of the wraparound carrier 16 lie in a generally common plane at each end of the carrier 16 and the gussets 18 have been folded beneath the top panels 28, 40, 42, minimal space may be maintained between groups of bottles which are being packaged. Because of this feature, it will be seen that the wraparound carrier which is the subject of this invention, may be applied to groups of bottles at the same rate as though the gussets and end panels did not exist. This is because no folding of the end panels 20, 22 and the gussets 18 in a longitudinal direction of the group of bottles occurs after the wraparound container is applied to a group of bottles or like articles. As will be readily apparent from the end view of FIG. 7 and the top perspective view of FIG. 8, the resultant package completely confines the bottles of other articles packaged within the wraparound carrier except for the limited exposure at the openings 54, 68 and 74.

Figure 7:
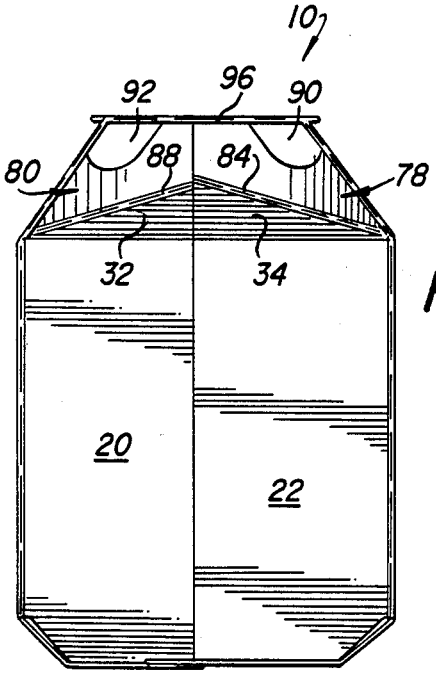
FIG. 7 is an end view of the resultant package.
Figure 6:
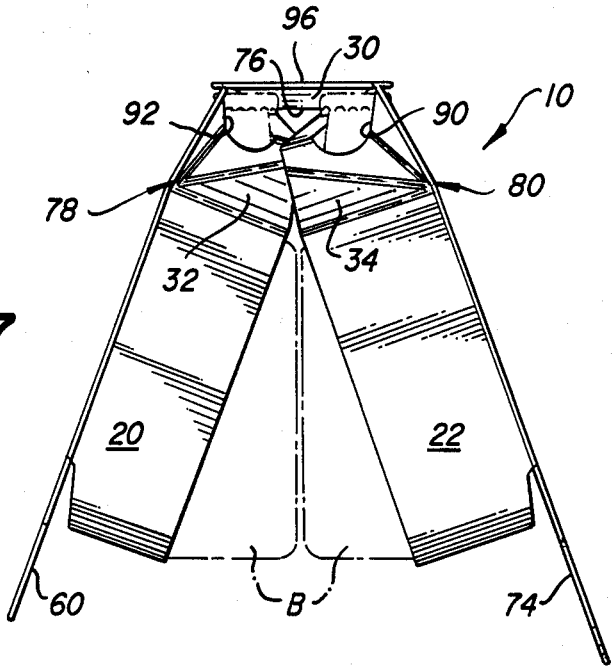
FIG. 6 is a schematic elevational view similar to FIG. 5 showing a further folding of the carrier down and around the rows of containers.
Figure 8:
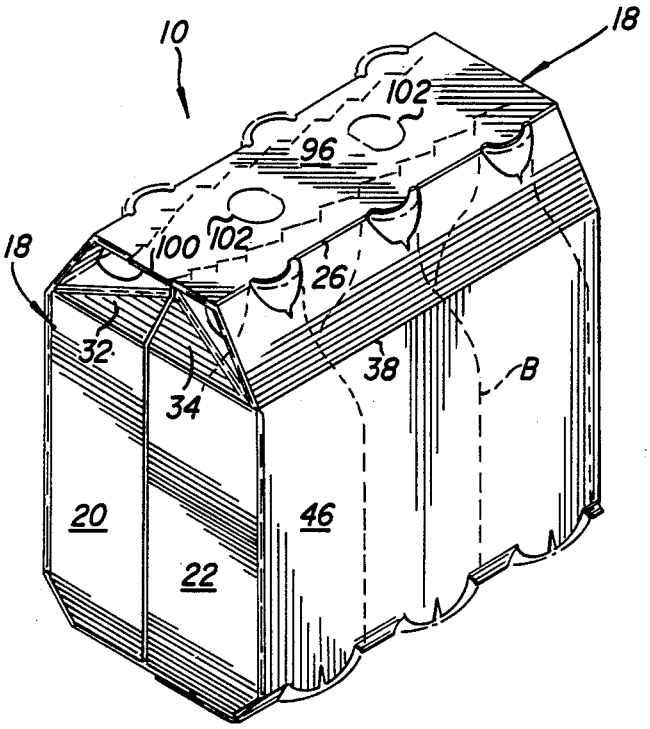
FIG. 8 is a top perspective view of the package and shows generally the details thereof.

Referring now to FIG. 6, it will be seen that as the bottle group moves along the usual package forming path, the gussets 18 fold further into the package and the end panels 20, 22 move together. As the package is completed, as shown in FIG. 7, the end panels 20, 22 move into slightly overlapping relation.

Returning once again to FIG. 1, it will be seen that the central top panel 28 has formed therein a plurality of spaced cut lines 94 arranged in two rows to define a removable opening panel 96. The two rows of interrupted cut lines 94 extend to the fold line 12 where they terminate in alignment with a generally C-shaped cut 98 formed in the gusset 18 which is adjacent the fold line 12. The C-shaped cut 98 defines a projecting pull tab 100 to facilitate the initiation of the rupture of the central top panel 28 along the interrupted cut lines 94.

When one desires to dispense the contents of the wraparound carrier 16, the pull tab 100 is pulled and the opening strip 96 is pulled entirely back to provide access to the interior of the wraparound carrier 16.

Figure 9:
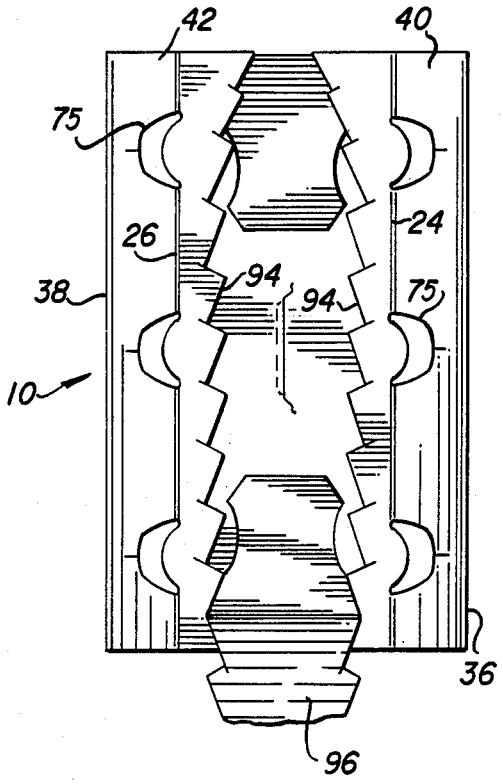
FIG. 9 is a schematic top plan view of an empty article carrier formed in accordance with the invention in its empty and form retaining state.

Further, as is shown in FIG. 9, even when the articles or bottles have been removed, the empty wraparound carrier 16 maintains its form. Thus the carrier 16 may be utilized to hold empty bottles and effect the return thereof in areas where there is a deposit on the bottles or where return of the bottles is a necessity.

It is to be noted that combination cut and fold lines 102 in the removable panel 96 define finger receiving openings 104 for facilitating the carrying of the resultant package.

Figure 10:
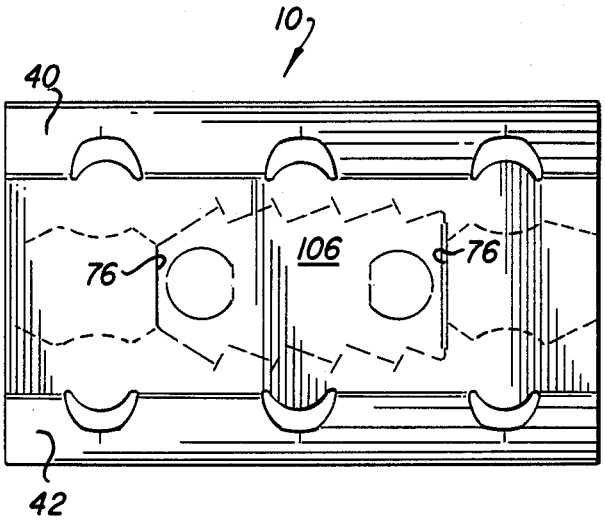
FIG. 10 is a top plan view of a modified form of article carrier with the opening strip extending only between opposed ends of the gusset.

It is to be understood that the elongated opening panel 96 is utilized only when the gussets 18 are not bonded to the central top panel 28. When the gussets 18 are bonded to the underside of the central top panel 28, the opening panel is modified as is shown in FIG. 10 and identified by the numeral 106. It is to be noted that the opening panel 106 extends only between the gussets 18 and terminate generally in alignment with the cutouts 76. The resultant opening in the central top panel 28 is, however, of sufficient length to facilitate the removal of all six bottles or like articles.

At this time it is pointed out that while the gusset 18 is specifically configurated for use in conjunction with a wraparound carrier having an arched top, the invention is in no way restricted to the bottom construction of the carrier nor the manner in which the partial bottom panels interlock or are otherwise connected together.

Although only a preferred embodiment of the wraparound carrier and the blank for forming the same have been specifically illustrated and described herein, it is to be understood that minor variations may be made in the wraparound carrier without departing from the spirit and scope of the invention as defined by the appended claims.

We claim:

1. In a wraparound article carrier of the type including a central top panel, downwardly and outwardly sloping top panels, side panels, and interconnected bottom panels, an end panel construction comprising a trap gusset unit including panels hingedly connected to said central and sloping top panels and to one another, and end doors hingedly connected to both said trap gusset and a respective one of said side panels.

2. An article carrier according to claim 1 wherein each end door is connected to a respective side panel for the full height of said side panel.

3. An article carrier according to claim 1 wherein each end door is connected to said trap gusset for the full width of said end door.

4. An article carrier according to claim 3 wherein said end doors and said trap gusset are of like widths.

5. An article carrier according to claim 1 wherein said end doors and said trap gusset are of like widths.

6. An article carrier according to claim 1 wherein said trap gusset includes three panels, one panel for each of said central and sloping top panels.

7. An article carrier according to claim 6 wherein said sloping top panels are joined to said central top panel along fold lines, and said three gusset panels are hingedly connected to one another along aligned extensions of said fold lines.

8. An article carrier according to claim 7 wherein said gusset panels include a central panel and outer panels, and a major portion of said central panel is folded flat beneath said central top panel.

9. An article carrier according to claim 7 wherein said gusset panels include a central panel and outer panels, and a major portion of said central panel is folded flat beneath said central top panel and bonded thereto.

10. An article carrier according to claim 8 wherein there is a corner between each sloping top panel and respective ones of said side panel, end panel and gusset outer panel, and there is a first diagonal fold line extending from said corner across said respective gusset outer panel and said gusset central panel, and a second diagonal fold line extending from said corner and across only said respective gusset outer panel, said respective gusset outer panel between said first diagonal fold line and the respective sloping top panel being folded flat beneath said respective sloping top panel, and a remainder of said respective gusset outer panel being in the form of an open fold along said second diagonal fold line.

11. An article carrier according to claim 8 wherein said article carrier is particularly shaped and sized to receive articles having reduced cross section top portions, and there is a cutout in said gusset bridging said gusset central panel and each respective gusset outer panel to provide clearance for an adjacent article top portion.

12. An article carrier according to claim 9 wherein said central top panel has an opening strip extending only between said gusset center panels.

13. A blank for forming an article carrier of the wraparound type having closed ends, said blank being in the form of a generally rectangular sheet divided by parallel longitudinal fold lines into a central carrier member having along each side thereof end door panels each having a central longitudinal axis which extends parallel to said longitudinal fold lines and which are joined by a trap gusset.

14. A blank according to claim 13 wherein there are aligned straight first transverse fold lines dividing said carrier members into a central top panel and outer top panels and said gusset into a central panel and outer panels, second transverse fold lines separating said outer top panels from side panels and said gusset from said end door panels.

15. A blank according to claim 14 wherein each gusset has corners defined by respective ones of said longitudinal fold lines and si second transverse fold lines, and each of said gusset outer panels having a first diagonal fold line extending from a respective corner across both said gusset outer panel and said gusset central panel, and a second diagonal fold line extending from said respective corner across said gusset outer panel.

16. A blank according to claim 15 wherein for each of said gussets, a respective longitudinal fold lines and respective first and second diagonal fold lines form means for permitting a major portion of said gusset central panel to be reversely folded against said central top panel.

17. A blank according to claim 16 wherein said reversely folded gusset central panel portion is bonded to said central top panel.

18. A blank according to claim 15 wherein each gusset has a portion of both said gusset central panel and each gusset outer panel absent to provide clearance for a top portion of an article to be packaged in said article carrier, each said absent portion extending along said second transverse fold line and across said first diagonal fold line.

19. A method of shaping an article carrier for positioning over articles to be formed with said article carrier into packages, said method comprising the steps of providing a blank for forming an article carrier of the wraparound type including a central top panel, sloping outer top panels and depending side panels, providing said blank at each side thereof with an integral gusset hinged to said top panels and integral end panels hinged to each of said side panels and a respective gusset, folding said gussets and said end panels down relative to said article carrier at each end of said article carrier, folding said outer top panels and said side panels downwardly in sloping relation with respect to said central top panel and said gussets reversely folding and underlying said central top panel, applying said thus folded article carrier to a group of articles arranged in two rows and folding said article carrier around the group of articles to an inverted U-shaped configuration with said outer top panels sloping downwardly and outwardly relative to said central top panel and said side panels depending from said outer top panels and said end panels closing ends of the thus partially formed article carriers, and completing said article carrier.

20. The method of claim 19 wherein said gussets are bonded to the underside of said central top panel to maintain the shape of the finally formed article carrier after articles have been removed therefrom.

* * * * *